United States Patent [19]

Farris

[11] Patent Number: 4,967,624

[45] Date of Patent: Nov. 6, 1990

[54] LOCKING FOR RATCHET TOOL

[76] Inventor: Jim Farris, Rte. 1, Box 260, Sheridan, Ark. 72150

[21] Appl. No.: 500,482

[22] Filed: Mar. 28, 1990

[51] Int. Cl.[5] ..... B25B 13/46

[52] U.S. Cl. ..... 81/63

[58] Field of Search ..... 81/60–63.2

[56] References Cited

U.S. PATENT DOCUMENTS

| | | | |
|---|---|---|---|
| 685,698 | 10/1901 | Sprague | 81/63 |
| 2,058,855 | 10/1936 | Chapman | 81/63 |
| 2,957,377 | 10/1960 | Hare | 81/63 |
| 3,019,682 | 2/1962 | Hare | 81/63.2 |
| 3,608,402 | 9/1971 | Rainey | 81/63.1 |
| 3,659,484 | 5/1972 | Scodeller | 81/63 |
| 3,724,298 | 4/1973 | Howard | 81/63 |
| 4,254,675 | 3/1981 | Marlow et al. | 81/63 |
| 4,869,138 | 9/1989 | Farris | 81/63 |

*Primary Examiner*—D. S. Meislin

*Attorney, Agent, or Firm*—Veo Peoples, Jr.

[57] ABSTRACT

An improved ratchet tool having a head member and a tubular member attached thereto. The head member includes a ball and pin for engagement with a rotating lock member. A handhold having a spacer plate attached thereto is telescoped over the tubular member wherein a pin extending from the spacer plate engages a notch in the tubular member to limit relative rotation of the handhold to 45 degrees.

1 Claim, 3 Drawing Sheets

LOCKING FOR RATCHET TOOL

BACKGROUND OF THE INVENTION

This invention relates to tools, and more particularly to an improved ratchet handle for socket wrenches or similar tools.

Ratchet handles for tools of this general kind have long been available, as for example, from U.S. Pat. Nos. 2,058,855; 2,957,377; 3,019,682; and 685,698. They are required by mechanics and workmen who must manipulate tools in cramped or relatively inaccessible locations where insufficient operating rom is available for movement of tools not equipped with the ratchet feature. The ratchet handles have conventionally been provided with any of a variety of small levers or dials to be operated by the user in order to change the direction of effective movement of the tool driver components of the handle. These levers have bee located in various positions for operation by the workman's fingers. No matter how accessible they may be, however, manipulation of these levers or dials almost always requires use of the workman's "free" hand, or else release of his grip on the ratchet handle.

Generally, the workman cannot conveniently remove his grip on the handle without losing the precise positioning of the tool which may be important to the operation in which the workman is engaged. The so-called "free" hand may be very vitally engaged in holding some other article necessary to the operation. The entire problem is aggravated by the restricted or cramped position often available to the workman, and also by the presence of slippery oils and releases which frequently coat the tools and handles when the direction change is to be made.

To overcome these problems, ratchet tool handles have been developed which permit a change in the direction of effective drive by a mere twist of the workman's wrist. See for example. U.S. Pat. No. 3,608,402. However, such devices have been previously locked by action of a springy projectile for biasing wedge members without or away from cam surfaces at one side or the other of the housing itself. The yieldable character of these spring members fail to provide adequate and secure locking of the rotor and require the locking positions for adjustment at 180 degree turns or the like. Such tools require an excessive number of parts, are cumbersome to manufacture, and are inconvenient to use in restricted places where a 180 degree turn of the workman's wrist is impractical.

More recently, U.S. Pat. No. 4,869,138 describes a more simple and more secure ratchet tool whose novel rotary lock construction permits operational change of direction upon a 45 degree turn of the shaft from its neutral position, which patent is herewith incorporated by reference. Nevertheless, the drawbacks to this device are that its ball member, which is received by a coil spring to assert engaging pressure against the rotary lock, operates somewhat inconsistently. There is the risk that the ball can occasionally slip out of position, thus preventing the otherwise free change of direction of rotation of the wrench. A more secure member to engage the rotary lock would represent a welcomed advancement in the manufacture of this tool. Furthermore, in the operation of this prior art ratchet tool, excessive pressure in twisting the handhold can force the rotary lock beyond a 45 degree turn and again freeze-up the wrench.

SUMMARY OF THE INVENTION

Accordingly, it is a primary object of this invention to provide an improved ratchet tool constructed to more securely assert engaging pressure against its rotary lock, and constructed to reinforce against applying excessive hand pressure in manually operating its handhold to change the direction of rotation of the tool.

It is a further object of the present invention to provide an improved ratchet tool handle, lockable by turning the handle with the workman's wrist, having a more secure self-locking feature as against the biased direction.

Another object of the invention is to provide a ratchet mechanism which may be shifted to opposite operating direction conditions by a rotary wrist action without necessitating a camming action against the housing of the wrench.

These and other objects of this invention will be further explained or will become apparent from the several drawing figures, from the specification, and the claims.

Figure 6A:
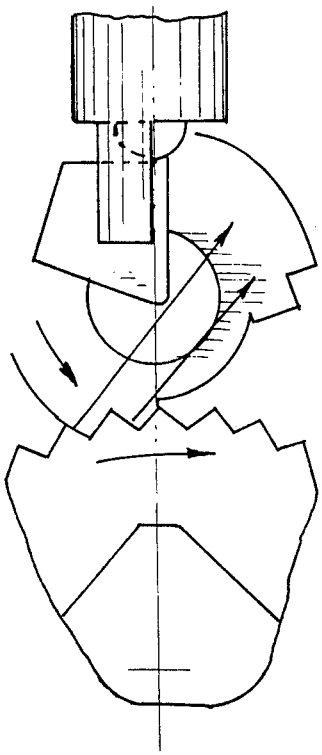
Figure 7A:
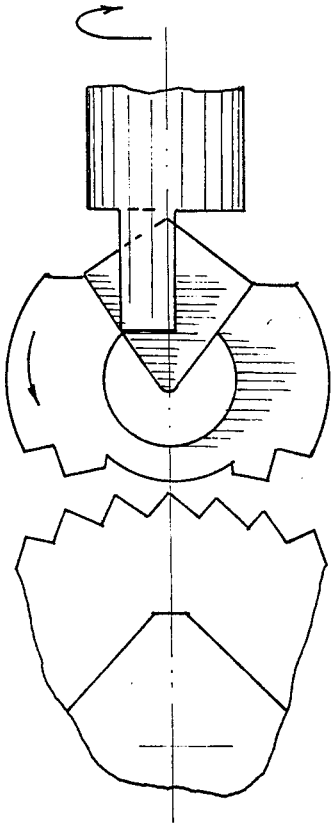
Figure 8A:
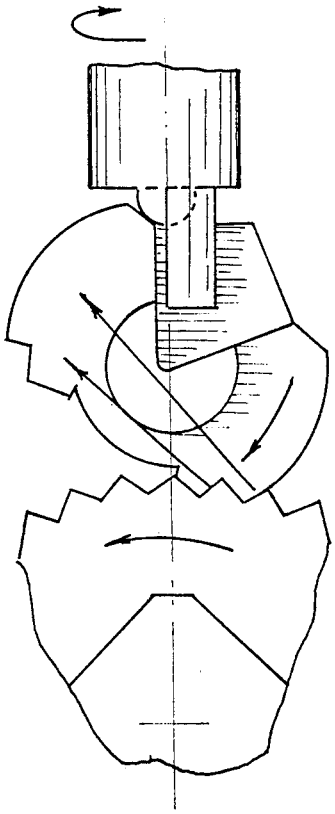
Figure 6:
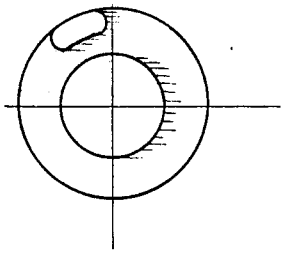
Figure 7:
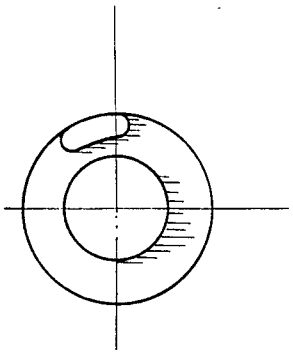
Figure 8:
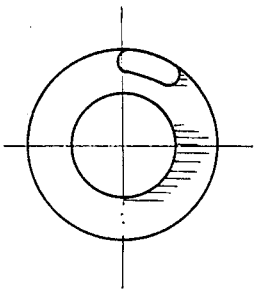

is a perspective view of the rotary lock of the ratchet tool of the present invention;

FIGS. 6 and 6*a* are fragmentary top views of the rotor engaging the rotary lock while the shifter finger biases the lock, and thus the rotor, against counterclockwise rotation;

FIGS. 7 and 7*a* are fragmentary views of the rotor and rotary lock disengaged as the shifter finger is midway between securing the respective locking positions;

FIGS. 8 and 8*a* are fragmentary drawings showing the rotor and rotary lock engaged while the shifter finger biases against clockwise motion.

DETAILED DESCRIPTION

Figure 1:
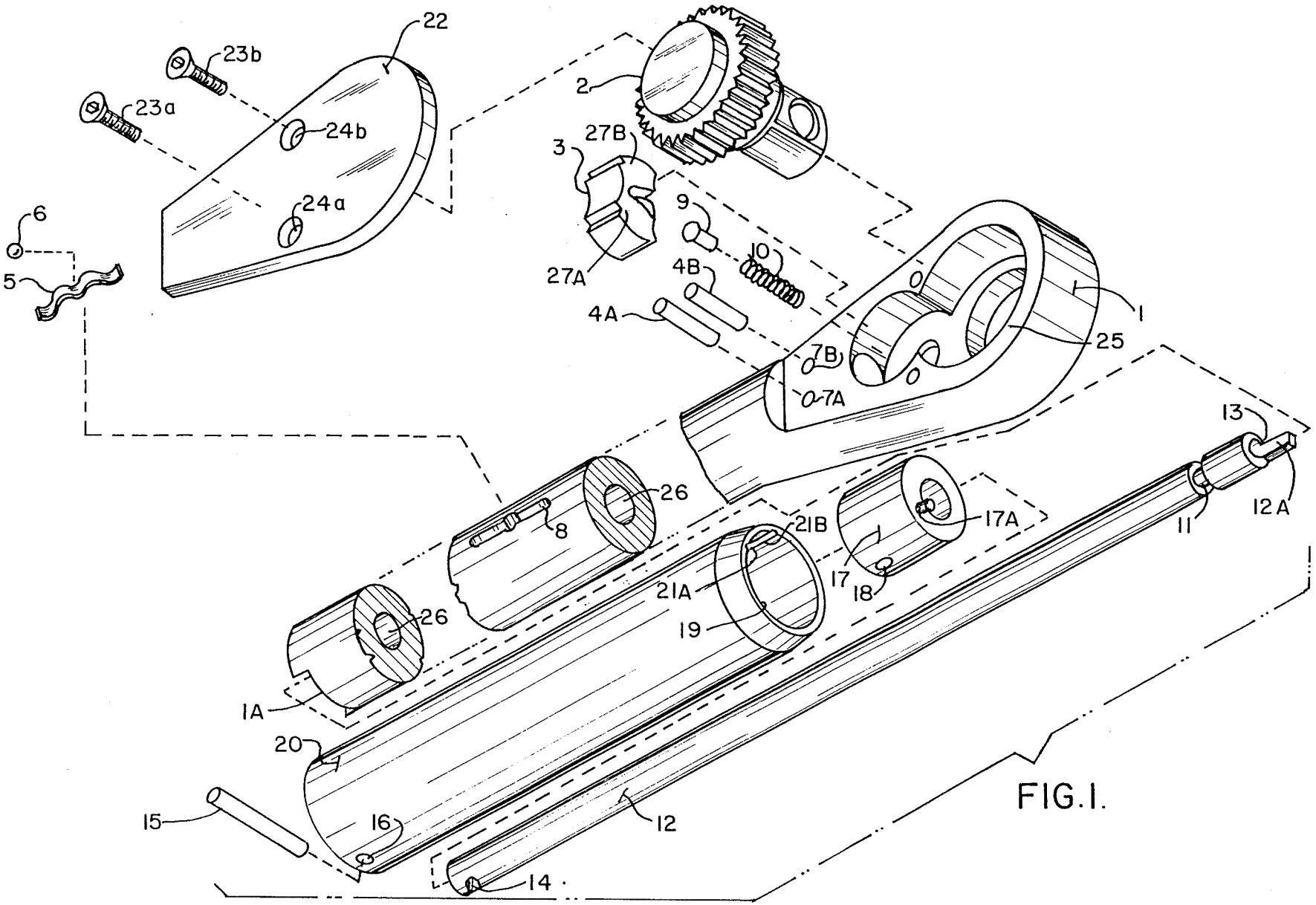
FIG. 1 is a perspective view of the disassembled parts of the ratchet tool handle of this invention embodying dotted lines describing its construction.

A ratchet handle embodying the principals of this invention is broadly designated in FIG. 1 of the drawings. Reference numeral (1) designates tho housing or outer body of the wrench handle having an oblonged surface opening (25) at its large end or tube, a surface slot (8) along its smaller cylindrical end, two parallel holes (*7a*) and (*7b*), a notch (1*a*) indented at the bottom of its smaller cylindrical end, and a generally circular inner wall surface throughout its smaller cylindrical end. The inner surface (26) of the ratchet handle body (1) receives in telescoped relationship an elongated, transversely circular, solid shaft or shifter rod (12). A tubular member (20) is telescoped over the outside of the small end of the housing (1). Member (20) is integrally connected with shaft (12) by an end plate spacer (17), having a pin member (17*a*) protruding from its upper surface and which is inserted within the notch (la) and the large end of the tubular handhold (20), whose small hole (16) is aligned with the small hole of the end spacer (18) and the small hole of the shaft (14) to receive pin (15) that secures the integral connection as between these three members, the handhold tubular member (20), the end spacer (17), and the shaft (12).

Figure 3:
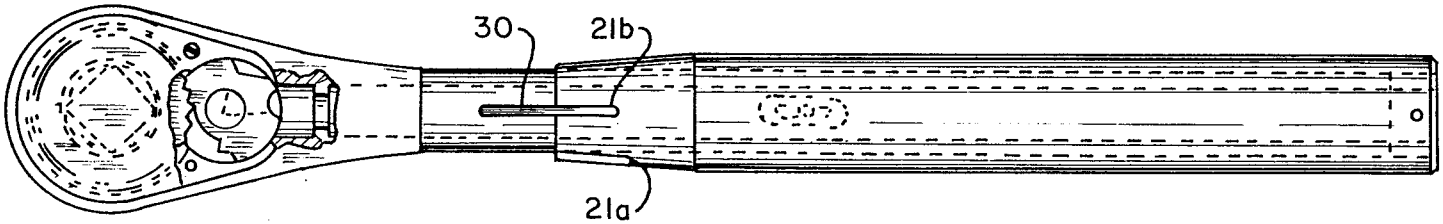
FIG. 3 is a partial cross-sectional top view of the ratchet tool handle of the invention.

Roll pins (4*a*) and (4*b*) fit securely through laterally bored holes (7*a*) and (7*b*), respectively, of the housing (1), and serve to retainably align the shaft by engagement with the groove (11) of the shaft as is more clearly demonstrated by the fractional cross-section shown in FIG. 3. FIG. 1 furthermore shows how the rotary lock (3) fits rotatably into the lower portion of the oblong opening (25) with the rotary locks cam surfaces (27*a*) and (27*b*) placed towards the top of the assembly. The rotor (2) for driving the ratchet tool fits rotatably into the top portion of oblong opening (25). The oblong or egg-shaped face (22) fits over the rotor and rotary lock so as to close opening (25) and said face is secured by screws (23*c*) and (23*b*) on said plate or face.

A ball member (6) is rollingly engaged to engage with a wavy spring (5), which rests in slot (8) of the ratchet wrench housing or body (1). The top of the ball member (6) rests against a detent (28) on the inner surface of the tabular handhold (20) "to lock the housing to the handhold". The ball member rests sufficiently loosely in the detent (28) that wrist action of the handhole (20) allows the housing or body (1) of the wrench to release and rotate while fitting snuggly enough to prevent the body (1) from slipping or releasing when in the no-load position.

Figure 2:
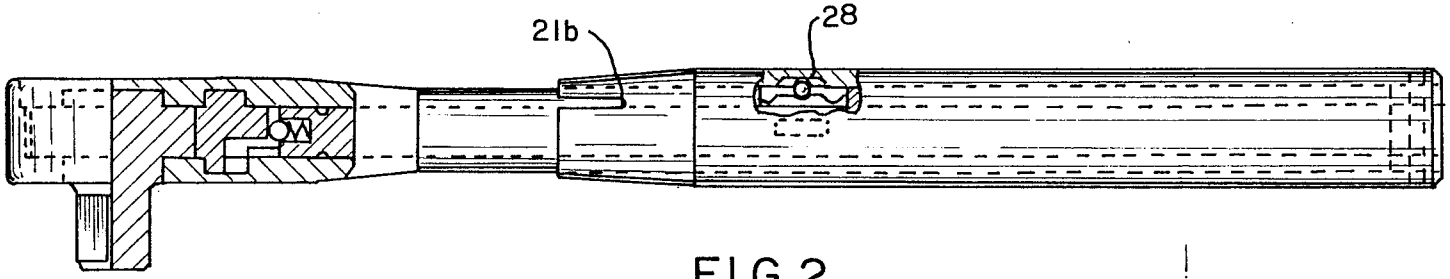
FIG. 2 is a partial cross-section side view of the ratchet tool handle of the present invention showing the engagement of the rotor, the rotary lock, the shifter finger, a ball and spring guide, and the housing, together with the shaft at its top cross-sectional purview.
Figure 5:
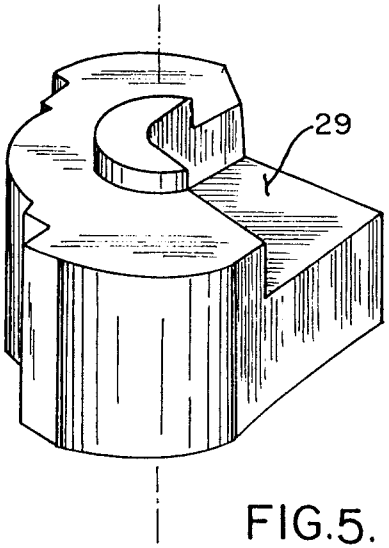

FIG. 2 of the drawings shows a cross-section that illustrates the interconnection of the detent (28), the ball member (6), the wavy spring (5), and the slot (8).

Figure 4:
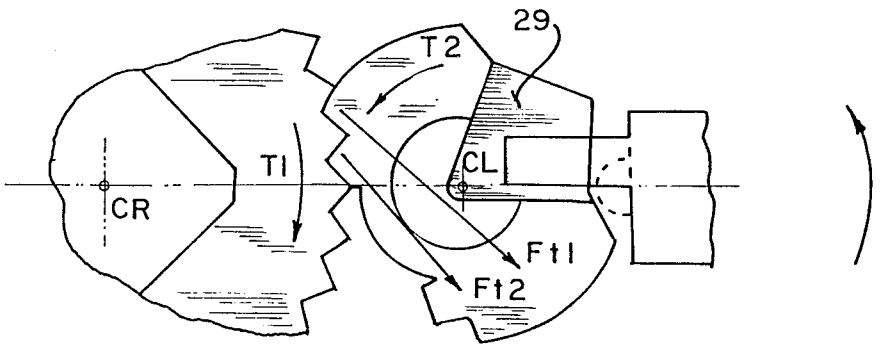
FIG. 4 is a fragmentary view of the engagement of the rotor and the rotary lock of the invention, having a magnified perspective of the shifter rod finger projecting into the recess of the rotary lock.

At the top end of the shaft or shifter rod (12), referring now to FIG. 1, there is a circular detent (13) centered on the top face of the shaft. The detent (13) receives a coil spring (10) and a ball and pin (9) that work together to provide sufficient engaging force against the rotary lock (3). Unlike spring members from prior art ratchet tools such as in U.S. Pat. No. 4,869,138, herewith incorporated by reference, which have a ball that can occasionally slip out of position, the ball and pin (9) of this present invention extends more securely into the coil spring (10). The ball and pin (9) and spring (10) of the present invention merely assert engaging pressure without having to also bias the rotor in opposite directions, and therefore, the need for prior art wedge members and camming action against the housing of the wrench is negated. Also, fixed to the top end of the shaft or shifter rod is a shifter finger (12A), off-set radially from the shaft axis, which projects into a pie-shaped recess (29) having not more than a 90 degree angle of the rotary lock (3)as may be more readily shown in FIG. 4. Thus, upon a mere 45 degree turn of the handhold (20) in either direction, the shaft (12) which is connected to said handhold (20) by the rod (15) will turn the shifter finger biasing said rotary lock in one direction or the other, and the rotary lock (3) at its cam faces (27*a*) or (27*b*) would thus bias the rotor driving means (2) by engagement at the teeth of said rotor. Note FIB. 5 which displays pie-shaped central recess (29) of the rotor lock in a perspective fashion, and which indicates the point on the rotary lock that ball member (9) rollably and releasably engages the rotary lock. FIGS. 6, 7 and 8 show alternative biasing positions and the nonlocked or unloaded position of the rotary lock (3) and rotor (2) together with the shifter finger (12) placement and the ball (9). The ratchet tool handle of the present invention is of a simpler construction, more secure, and permits selected change in the direction or effective relative rotation between clockwise and counterclockwise by a mere twist of the wrist at no more than 45 degrees, and without any necessity for releasing the grip on the tool, while also permitting secure bias one direction against the other under loaded conditions without any give which was previously a drawback in ratchet tool wrenches of this type and reinforced against excessive manual pressure. Furthermore, the wrench is more sturdy and has a longer working life because the walls of the housing of said wrench are not used as cam members, and therefore, do not wear out with time as did prior art devices of this type.

Having thus described the invention, it should be noted that the details of the description and drawing on embodiments re intended for illustrative purposes and should not be seen to unduly limit the present invention.

What is claimed is:

1. An improved ratchet tool, for changing operational direction upon manual rotation of a handhold, said tool consisting of the following members:

A. A one-piece housing with an integrally connected head and tubular member,

B. A rotary lock within the head of the housing to drive the tool, said rotary lock having a spring member to assert engaging pressure thereagainst, C. A shaft telescoped within the tubular member of the housing thereagainst, D. An elongated handhold telescoped ones the tubular member of the housing, said handhold having an end spacer plate attached thereto and inserted therein, said shaft being connected at one end to said end spacer plate, the improvement comprising:

i. A ball and pin member within the engaging spring for the rotary lock to more securely assert engaging pressure, and ii. A peripheral notch indented within the end of the tubular member of the one-piece housing, and iii. A pin protruding from the end plate member which protrudes into the notch;

whereby the ratchet tool is permitted to change directions more freely and more consistently and whereby there is an improved reinforcement against turning the handhold more than 45 degrees from it neutral or nonlocked position when changing operational direction of the ratchet tool.

* * * * *